US008052507B2

(12) United States Patent
Huang et al.

(10) Patent No.: US 8,052,507 B2
(45) Date of Patent: Nov. 8, 2011

(54) DAMPING POLYURETHANE CMP PADS WITH MICROFILLERS

(75) Inventors: David Picheng Huang, Westfield, IN (US); Ming Zhou, Boxborough, MA (US); Timothy Dale Moser, Brownsburg, IN (US)

(73) Assignee: Praxair Technology, Inc., Danbury, CT (US)

( * ) Notice: Subject to any disclaimer, the term of this patent is extended or adjusted under 35 U.S.C. 154(b) by 711 days.

(21) Appl. No.: 11/943,213

(22) Filed: Nov. 20, 2007

(65) Prior Publication Data

US 2009/0137120 A1 May 28, 2009

(51) Int. Cl.
*B24D 11/00* (2006.01)

(52) U.S. Cl. ..... 451/526; 156/78; 51/295; 51/296

(58) Field of Classification Search ..... 451/526; 51/296; 264/51

See application file for complete search history.

(56) References Cited

U.S. PATENT DOCUMENTS

| | | | | |
|---|---|---|---|---|
| 3,817,882 | A | 6/1974 | Hostettler et al. | |
| 6,454,634 | B1 | 9/2002 | James et al. | |
| 6,514,301 | B1 | 2/2003 | Lombardo | |
| 6,582,283 | B2 | 6/2003 | James et al. | |
| 6,627,671 | B1 | 9/2003 | Kihara et al. | |
| 6,705,934 | B1 | 3/2004 | Shiro et al. | |
| 6,777,455 | B2 | 8/2004 | Seyanagi et al. | |
| 6,860,802 | B1 | 3/2005 | Vishwanathan et al. | |
| 6,899,611 | B2 | 5/2005 | Reinhardt et al. | |
| 6,918,821 | B2 | 7/2005 | Balijepalli et al. | |
| 6,984,163 | B2 | 1/2006 | Roberts | |
| 7,074,115 | B2 | 7/2006 | James et al. | |
| 7,097,549 | B2 | 8/2006 | Allison et al. | |
| 7,097,550 | B2 | 8/2006 | Kawahara et al. | |
| 7,098,255 | B2 | 8/2006 | Seyanagi et al. | |
| 7,169,030 | B1 | 1/2007 | Kulp | |
| 7,192,340 | B2 | 3/2007 | Ono et al. | |
| 7,217,179 | B2 | 5/2007 | Sakurai et al. | |
| 2004/0157985 | A1 | 8/2004 | Masui et al. | |
| 2004/0224622 | A1* | 11/2004 | Sakurai et al. | 451/526 |
| 2005/0171225 | A1 | 8/2005 | Kulp | |
| 2006/0046064 | A1 | 3/2006 | Halberg et al. | |
| 2006/0084365 | A1 | 4/2006 | Sakurai et al. | |
| 2006/0226567 | A1 | 10/2006 | James et al. | |
| 2006/0254706 | A1* | 11/2006 | Swisher et al. | 156/253 |
| 2006/0276109 | A1 | 12/2006 | Roy et al. | |
| 2009/0093201 | A1 | 4/2009 | Kazuno et al. | |

FOREIGN PATENT DOCUMENTS

| | | | |
|---|---|---|---|
| WO | WO2009/029322 | A1 | 3/2009 |

* cited by examiner

*Primary Examiner* — Roberts Culbert
(74) *Attorney, Agent, or Firm* — Nilay S. Dalal

(57) ABSTRACT

A system for preparing a microcellular polyurethane material, includes a froth, prepared, for instance, by inert gas frothing a urethane prepolymer, preferably an aliphatic isocyanate polyether prepolymer, in the presence of a surfactant; a filler soluble in a CMP slurry; and a curative, preferably including an aromatic diamine and a triol. To produce the microcellular material, the froth can be combined with the filler, e.g., PVP, followed by curing the resulting mixture. The microcellular material has a low rebound and can dissipate irregular energy and stabilize polishing to yield improved uniformity and less dishing. CMP pads using the microcellular material have pores created by inert gas frothing throughout the pad polymer body and additional surface pores created by dissolution of fillers during polishing, providing flexibility in surface softness and pad stiffness.

18 Claims, No Drawings

DAMPING POLYURETHANE CMP PADS WITH MICROFILLERS

BACKGROUND OF THE INVENTION

Chemical mechanical planarization, also known as chemical mechanical polishing or CMP, is a technique used to planarize the top surface of an in-process semiconductor wafer or other substrates in preparation of subsequent steps or for selectively removing material according to its position. The technique employs a slurry that can have corrosive and abrasive properties in conjunction with a polishing pad.

While many existing CMP pads are non-porous, porous polishing pads generally provide improved slurry transport and localized slurry contact.

One technique for making high density foam polishing pads includes agitating a liquid polymer resin at a controlled temperature and pressure, using a surfactant, to produce a stable froth. The resin froth can be metered under pressure to a mix head where it is typically combined with a desired amount of curative before being injected or poured into a mold.

Other techniques for introducing porosity into pad materials include incorporating beads or hollow polymeric microspheres into the material. In some instances, a polymeric matrix used to manufacture the pad has been combined with polymeric microelements that soften or dissolve upon contact with a polishing slurry.

Many existing CMP pads have pore size limitations imposed by the technique used to create the microstructure. Gas frothing, for instance, can produce wider pore size distributions, larger than 30 microns (μm), whereas microspheres-filled pads often have pore sizes greater than 20-30 μm, depending on the size of the microspheres.

Generally, CMP is a dynamic process involving cyclic motion of both the polishing pad and the workpiece. During the polishing cycle, energy is transmitted to the pad. A portion of this energy is dissipated inside the pad as heat, and the remaining portion is stored in the pad and subsequently released as elastic energy during the polishing cycle. The latter is believed to contribute to the phenomenon of dishing of metal features and oxide erosion.

One attempt to describe damping effects quantitatively has used a parameter named Energy Loss Factor (KEL). KEL is defined as the energy per unit volume lost in each deformation cycle. Generally, the higher the value of KEL for a pad, the lower the elastic rebound and the lower the observed dishing.

To increase the KEL value, the pad can be made softer. However, this approach tends to also reduce the stiffness of the pad. The reduced stiffness results in decreased planarization efficiency and increases dishing due to conformation of the pad around the device corner.

Another approach for increasing the KEL value of the pad is to alter its physical composition in such a way that KEL is increased without reducing stiffness. This can be achieved by altering the composition of the hard segments (or phases) and the soft segments (or phases) in the pad and/or the ratio of the hard to soft segments (or phases) in the pad.

SUMMARY OF THE INVENTION

To address advances in electronic components, increasingly complex demands are being placed on CMP processing and equipment utilized to planarize semiconductor, optical, magnetic or other types of substrates. A need continues to exist for long lasting CMP pads that can provide improved slurry transport and removal rates and can meet requirements for within wafer (WIW) and within die (WID) uniformities. Also needed are pads that are less likely to cause scratching, dishing and/or erosion, as well as pads that require less conditioning.

It has been found that CMP pads with low rebound tend to absorb relatively high amounts of energy during cyclic deformation, causing less dishing during polishing and yielding better WID uniformity. Stiffness is an important consideration for WID uniformity and prolonged pad life, while decreased glazing during polishing reduces the need for pad conditioning.

The invention relates to producing CMP pad materials that have special properties, in particular a highly damping performance and/or improved pore structure at the working surface. These and other properties are obtained by altering the formulation and process for producing the pad. Choices in ingredients and specific combinations of materials, together with processes such as gas frothing have been found to affect the morphology of the polymeric material, resulting in a final product that has properties that are particularly advantageous in fabricating CMP pads.

In one aspect, the invention is directed to a system and method for producing a microcellular polyurethane material.

The system includes a urethane prepolymer, a curative and a filler. When combined under polymerization conditions the urethane prepolymer, the curative and the filler form a solid product having a Bashore rebound that is less than 38%.

The method includes frothing a urethane prepolymer to form a froth, incorporating a filler in the froth and curing the froth in the presence of a curative, thereby producing the microcellular polyurethane material, wherein a solid product formed by polymerizing the urethane prepolymer and filler in the presence of the curative has a Bashore rebound that is less than 38%.

It was discovered that systems that are combinations of polyether urethane prepolymers that contain aliphatic isocyanates, such as H12MDI or HDI, and curatives that include aromatic diamines tend to form highly damping polyurethane materials. It was further discovered that adding triol, e.g., to the aromatic diamine, tended to decrease the Bashore rebound of a solid material formed by polymerizing the prepolymer and curative. In addition to the pore structure generated by gas frothing, fillers that dissolve in a CMP slurry can add a second pore structure at the polishing or working surface of the pad.

In a preferred implementation of the invention, a system for producing a CMP pad comprises a froth that includes an inert gas, an aliphatic isocyanate polyether prepolymer, a polysiloxane-polyalkyleneoxide surfactant, a slurry-soluble filler and a curative that preferably includes an aromatic diamine. The particle size of the filler can be selected to impart a dual porosity at the working surface of the pad. In specific embodiments, the system also includes a triol, for instance as part of the curative. Triol levels can be optimized for higher damping performance.

In another preferred implementation of the invention, a method for producing a CMP pad includes frothing an aliphatic isocyanate polyether prepolymer with an inert gas, in the presence of a polysiloxane-polyalkyleneoxide surfactant, to form a froth; adding a slurry-soluble filler to the froth; and curing the filler-containing froth in the presence of a curative, e.g., an aromatic diamine and a triol.

The invention addresses demands placed on CMP pads used in the manufacture of traditional and advanced electronic, optical or magnetic components and has many advantages. The highly damping polymeric material of the invention has high energy dissipation and can absorb irregular bouncing and oscillating energy at the polishing interface to yield better uniformity. CMP pads manufactured from this material provide good WIW and WID uniformities, smooth polishing performance, low dishing and/or erosion. The pads generally have a high degree of stable hardness or stiffness, providing good planarization performance and long pad life. During operation, CMP pads fabricated from the highly damping microcellular materials described herein can absorb irregular bouncing and oscillating energy at the polishing interface, giving smooth polishing performance and low dishing/erosion on wafer surface.

The slurry soluble filler employed according to the invention can generate a second porosity at the CMP polishing interface resulting in decreased glazing and requiring less conditioning. Filler-induced porosity at the pad surface can retain additional slurry while fillers inside the pad body can change the hardness of pad resulting in gradient of porosity and hardness from top down of the polymer pad, thereby yielding improved WID uniformity during polishing. In preferred examples, the dual porosity distributions at the pad surface provides a flexibility in regulating surface pore size for retaining slurry. The dual porosity combination created by gas frothing and soluble fillers can be custom designed or optimized for specific polishing applications depending on the needs for removal rate and surface finish. The dual surface porosity described herein can require less microcellular porosity within the bulk material, making the pad stiffer (harder) and giving excellent polishing planarity.

By providing a wide range of particle sizes, fillers that dissolve in the CMP slurry can produce desired void sizes at the working interface, thus overcoming pore size limitations in existing CMP pads.

Testing and comparing material properties can be simplified by using solid products, formed by combining a urethane prepolymer with a curative under polymerization conditions, rather than microcellular samples which require additional process steps, e.g., frothing, and/or ingredients, e.g., surfactants.

Advantageously, the material can be prepared using precursors that are commercially available thus simplifying and facilitating the overall fabrication process. Aspects of gas frothing and casting can be carried out using standard techniques and/or equipment. In some systems, frothing time can be decreased without sacrificing foaming characteristics and quality.

DETAILED DESCRIPTION OF THE PREFERRED EMBODIMENTS

The above and other features of the invention including various details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

In one aspect, the invention relates to a damping polymeric material that is particularly well suited in the manufacture of CMP pads. As used herein, the term "damping" refers to the ability of a material to absorb mechanical energy. Preferably damping is measured by the Bashore rebound method, a simple technique for testing the rebound of a material. The Bashore rebound test is known in the art and is described, for instance, in the American Society for Testing and Materials (ASTM) Standard D-2632. Other methods for measuring rebound also can be used, as known in the art.

The polymeric material is a polyurethane, i.e., a polymer containing repeating urethane units. The polyurethane is produced from a system that includes at least one urethane prepolymer and a curative. The system can include other ingredients, e.g., surfactants, fillers, catalysts, processing aids, additives, antioxidants, stabilizers, lubricants and so forth.

Urethane prepolymers are products formed by reacting polyols, e.g., polyether and/or polyester polyols, and difunctional or polyfunctional isocyanates. As used herein, the term "polyol" includes diols, polyols, polyol-diols, copolymers and mixtures thereof.

Polyether polyols can be made through alkylene oxide polymerization and tend to be high molecular weight polymers, offering a wide range of viscosity and other properties. Common examples of ether-based polyols include polytetramethylene ether glycol (PTMEG), polypropylene ether glycol (PPG), and so forth.

Examples of polyester polyols include polyadipate diols, polycaprolactone, and others. The polyadipate diols can be made by the condensation reaction of adipic acid and aliphatic diols such as ethylene glycol, propylene glycol, 1,4-butanediol, neopentyl glycol, 1,6-hexanediol, diethylene glycol and mixtures thereof.

Polyol mixtures also can be utilized. For instance, polyols such as those described above can be mixed with low molecular weight polyols, e.g., ethylene glycol, 1,2-propylene glycol, 1,3-propylene glycol, 1,2-butanediol, 1,3-butanediol, 2-methyl-1,3-propanediol, 1,4-butanediol, neopentyl glycol, 1,5-pentanediol, 3-methyl-1,5-pentanediol, 1,6-hexanediol, diethylene glycol, dipropylene glycol and mixtures thereof.

The most common isocyanates utilized in preparing urethane prepolymers are methylene diphenyl diisocyanate (MDI) and toluene diisocyanate (TDI), both aromatic. Other aromatic isocyanates include para-phenylene diisocyanate (PPDI), as well as mixtures of aromatic isocyanates.

In specific aspects of the invention, the urethane prepolymers employed include aliphatic isocyanates such as, for instance, hydrogenated MDI (H12MDI), hexamethylene diisocyanate (HDI), isophorone diisocyanate (IPDI), other aliphatic isocyanates and combinations thereof.

Urethane prepolymers also can include mixtures of aliphatic and aromatic isocyanates.

Urethane prepolymers often are characterized by the weight percent (wt %) of unreacted isocyanate groups (NCO) present in the prepolymer. Wt % NCO can be used to determining mixing ratios of components for producing polyurethane materials.

Urethane prepolymers can be formed using synthetic techniques known in the art. In many cases, suitable urethane prepolymers also are commercially available.

Examples of commercially available polyether urethane prepolymers include some Adiprene® polyether prepolymers, from Chemtura Corporation, Middletown, Conn., some Airthane® prepolymers, from Air Products and Chemicals, Inc. Allentown, Pa., and others. In many cases, these prepolymers contain low levels of free monomer, e.g., TDI monomer, and are referred to as "low free" or "LF".

Specific examples of polyether urethane prepolymers include, for instance, those designated as (Adiprene®) LF 750D (a TDI-PTMEG prepolymer, LF, having a NCO of 8.79 wt %), L 325 (TDI/H12MDI-PTMEG prepolymer, having a NCO of 9.11 wt %), LFG 740D (TDI-PPG prepolymer, LF, having a NCO of 8.75 wt %), LW 570 (H12MDI-polyether prepolymer, having a NCO of 7.74 wt %), LFH 120 (HDI-polyether prepolymer, LF, having a NCO of 12.11 wt %) and Airthane® PHP-80D (TDI-PTMEG prepolymer, LF, having a NCO of 11.1 wt %). Other specific examples of urethane prepolymers that are commercially available include Andur® (Anderson Development Company), Baytec® (Bayer Material Science) and so forth.

Examples of polyester urethane prepolymers include, for instance, a TDI polyester urethane prepolymer designated as Vibrathane® 8570, having a NCO of 6.97 wt %, from Chemtura Corporation, Middletown, Conn. Other suitable polyester urethane prepolymers include but are not limited to Versathane® D-6 or D-7 from Air Products and Chemicals.

The curative is a compound or mixture of compounds used to cure or harden the urethane prepolymer. The curative reacts with isocyanate groups, linking together chains of prepolymer to form a polyurethane.

Common curatives typically used in producing polyurethane include 4,4'-methylene-bis(2-chloroaniline), abbreviated as MBCA and often referred to by the tradename of MOCA®; 4,4'-methylene-bis-(3-chloro-2,6-diethylaniline), abbreviated as MCDEA; dimethylthiotoluenediamine, trimethyleneglycol di-p-aminobenzoate; polytetramethyleneoxide di-p-aminobenzoate; polytetramethyleneoxide mono-p-aminobenzoate; polypropyleneoxide di-p-aminobenzoate; polypropyleneoxide mono-p-aminobenzoate; 1,2-bis(2-aminophenylthio)ethane; 4,4'-methylene-bis-aniline; diethyltoluenediamine; 5-tert-butyl-2,4- and 3-tert-butyl-2,6-toluenediamine; 5-tert-amyl-2,4- and 3-tert-amyl-2,6-toluenediamine and chlorotoluenediamine and others.

In specific aspects of the invention, the curative employed includes an aromatic amine, in particular an aromatic diamine, e.g., bis-(alkylthio) aromatic diamines. Commercial examples of suitable aromatic diamines include Ethacure® 300 (from the Albermarle Corporation, Richmond, Va.), which is a mixture containing 3,5-bis(methylthio)-2,6-toluenediamine and 3,5-bis(methylthio)-2,4-toluenediamine; and Ethacure® 100 (also from Albermarle Corporation) which is a mixture containing 3,5-diethyltoluene-2,4-diamine and 3,5-diethyltoluene-2,6-diamine.

In addition to the aromatic diamine component, preferred curatives include one or more other ingredients. For instance, to modify the urethane domain network or polymer structure, polymer cross-linking density is increased by introducing tri-functional agents for damping performance. Preferred examples of trifunctional agents include triols, for instance aliphatic triols such as trimethanolpropane (TMP), alkoxylated aliphatic triols, e.g. ethoxylated TMP, such as TP30, available from Perstorp Corporation, polypropylene ether triol having, for instance, a molecular weight of 100-900 and aliphatic amino triols such as Vibracure® A931, available from Chemtura, triethanol amine (TEA), and others. Mixtures of triols also can be employed.

Triol levels can be optimized for damping performance. Relative to the entire weight of the curative, triols or modified triols, e.g., alkoxylated triols, typically are used in an amount within the range of from 0.2 to 15 weight %. Other ratios can be employed.

In specific examples, the preferred curative for use with aliphatic (HDI or H12MDI) polyether urethane prepolymers is a mixture of Ethacure® 300 in combination with 5-10% wt triol, and in particular the combination of Ethacure 300 with 5% TMP.

Relative amounts of urethane prepolymer and curative can be determined, for instance, by taking into account the % NCO of a given urethane prepolymer. The curative can be added to give a combination of amine and hydroxyl groups at about, e.g., 95%, of the available isocyanate groups in the prepolymer on an equivalent basis. In most instances, curative is added at 90-105% the theoretical amount.

In other embodiments, triol can be added individually or with ingredients other than the curative.

The Bashore rebound preferably is measured using a solid product obtained by combining a urethane prepolymer and a curative under polymerization conditions, e.g., suitable temperatures and time periods to cure or harden the combination into a solid product. Generally, the solid product is formed without subjecting the prepolymer to a process intended to introduce microscopic sized voids into the material, for example in the absence of frothing, further discussed below.

Preferred prepolymer-curative combinations polymerize to form a solid product that has a rebound less than about 38%, as measured by the Bashore rebound test. Highly damping solid products, e.g., having a rebound lower than 35%, were obtained from systems that include H12MDI or HDI polyether prepolymers and a curative that is a mixture of Ethacure® 300 and 5 weight % TMP.

The solid product can be used to screen candidate systems with respect to other properties such as hardness. In preferred examples, the solid product has a hardness in the range of from about 30 D to about 85 D, e.g., from 55 D to 80 D. The Shore D scale, utilizing Durometer testing, is a well known approach for defining hardness of polymeric materials and generally is applied to plastics harder than those measured on the Shore A scale. The Shore D hardness was measured according to ASTM D 2240.

Other properties that can be studied and compared using a solid product formed by combining a urethane prepolymer and a curative under polymerization conditions include processability, i.e., the ability to form froth and mixing, chemical stability of the product vis-à-vis slurries employed in CMP processing, viscosity of the system, release of free monomer, e.g., TDI, during processing, pot life, color, and so forth.

For manufacturing CMP pads, the polyurethane material is microcellular, containing microscopically sized voids which typically are formed by processes targeted at incorporating such voids into the structure of the material. During CMP planarization, the voids or micropores retain slurry for polishing the surface of the workpiece.

In specific aspects of the invention, at least a portion of the void volume is formed by frothing with a gas such as nitrogen, dry air, rare gases, e.g., helium, argon, xenon, as well as other gases or gas mixtures. Gases that do not cause chemical reactions such as oxidation reactions in the foam are preferred and are referred to herein as "non-reactive" or "inert" gases. Particularly preferred is nitrogen.

Frothing is described, for instance, in U.S. Pat. No. 6,514,301B, issued to Brian Lombardo on Feb. 4, 2003, the teachings of which are incorporated herein by reference in their entirety. Preferably, frothing produces microstructures with adjustable pore size and distribution. In one example, the microcellular polyurethane material has pores greater than about 30 μm.

Frothing the prepolymer can be conducted in the presence of one or more surfactant(s), e.g., non-ionic or ionic surfactant(s). Including a surfactant can be particularly beneficial in systems having low viscosity.

A stable froth (foam) is preferred in creating microstructure in polyurethane materials and is believed to result, at least in part, from the adsorption and partition of hydrophobic hydrocarbon chains of surfactant at the air/polymer interface causing changes in surface tension and reaction of its functional group with the polymer.

It is desirable to select a surfactant which, when used with a specific urethane prepolymer, easily produces froth, preferably using simple processing and equipment. Froths that are stable and maintain their integrity when subjected to varying processing conditions, e.g., shear, temperature or pressure variations, typically employed during processing also are preferred. It was also found that surfactant selection could affect not only frothing intensity or froth stability but also pore size, an important parameter for polymeric materials used to manufacture CMP pads.

Examples of suitable surfactants include silicone surfactants such as, for instance, copolymers containing at least one block comprising polydimethylsiloxane and at least one other block comprising polyether, polyester, polyamide, or polycarbonate segments.

In specific embodiments the surfactant is a polysiloxane-polyalkyleneoxide (or polysiloxane-polyalkylene oxide) surfactant. Polysiloxane-polyalkyleneoxide surfactants also are known in the art as a silicone copolyols and can include polymeric, oligomeric, copolymeric and other multiple monomeric siloxane materials.

Polysiloxane-polyalkyleneoxide surfactants can be copolymers that comprise a polysiloxane backbone comprised of siloxane units, and polyalkyleneoxide sidechains. The polysiloxane backbone can be either straight chain, branched chain or cyclic in structure. The polyalkyleneoxide sidechain of copolymers may include polyethyleneoxide, polypropyleneoxide, polybutyleneoxide macromonomers and so forth, or mixtures thereof. Optionally, the sidechains may also include polyethylene, polypropylene, polybutylene monomers. The polyalkyleneoxide monomer can be present in an amount greater than about 10%, preferably greater than about 20%, and more preferably greater than about 30% by weight of the copolymer.

Polyethyleneoxide sidechain macromonomers are preferred. Also, preferred are polypropyleneoxide sidechains, and sidechains comprising polyethyleneoxide and polypropylene oxide at a mole ratio of from about 1:2 to about 2:1.

Particularly useful are copolymers having a molecular weight ranging from about 2,000 to about 100,000 g/g-mole, preferably from about 10,000 to about 80,000 g/g-mole, more preferably from about 15,000 to about 75,000, even more preferably from about 20,000 to about 50,000, and most preferably from about 25,000 to about 40,000.

The polysiloxane-polyalkyleneoxide copolymers of the present invention can have a surface tension of less than about 40 mN/m, preferably less than about 30 mN/m, and more preferably less than about 25 mN/m. The surface tension is measured by the Wilhelmy plate test method according to ASTM D1331-89 using a 0.1% by weight solution at 25° C.

The copolymers can have a Ross Miles foam height of less than about 60 millimeters (mm), preferably less than about 40 mm, more preferably less than about 20 mm, and most preferably less than about 10 mm. The Ross Miles foam height test is performed according to ASTM C1173-53 using 1% by weight solutions and taking 5 minute readings. Additionally, the copolymers can have a hydrophile-lipophile balance (HLB) greater than or equal to about 4, preferably greater than or equal to about 6, and more preferably greater than or equal to about 8.

Examples of commercially available surfactants that can be used are some available from GE Silicones under the designation of Niax®, for instance L-7500, L-5614, L-1580; from Air Products and Chemicals, e.g., under the designation of DC-193, DC-5604 and DC-5164; and from Dow Corning Corporation, Midland, Mich., e.g., under the designation DC-309, 5098EU and Q2-5211 (methyl(propylhydroxide, ethoxylated) bis(trimethylsiloxy)silane).

The surfactant preferably is selected based on parameters such as foaming intensity, stability or cell size obtained during frothing. For many urethane prepolymers that include aromatic isocyanates, a suitable surfactant is Niax® L-1800 (a polydimethylsiloxane polyoxyalkylene block copolymer surfactant) available from GE Silicones, now Momentive Performance Materials. Preferred surfactants for frothing aliphatic isocyanate polyether prepolymers, e.g., H12MDI-polyether or HDI-polyether, include DC-193 and Q2-5211.

Amounts of surfactant can be determined experimentally, for instance by evaluating frothing characteristics and/or properties of the end product. Typically, surfactant levels are within the range of from about 0.3 to about 5% by weight with respect to the total weight of prepolymer and surfactant. Surfactant amounts also can be expressed as parts per hundred parts of resin (PHR). In many cases, a suitable surfactant amount was around 1.5 PHR. Other amounts can be selected.

The system also includes at least one filler that is soluble in the slurry employed during CMP polishing. More than one type of slurry-soluble fillers can be employed.

Generally, the slurry provides mechanical as well as chemical action by combining abrasives and compounds that can chemically affect the substrate being planarized. Many CMP slurries are aqueous-based formulations developed for specific applications and can include pH adjusters, chelating agents, lubricants, surface modifiers, corrosion inhibitors and so forth. Examples of abrasives that can be utilized are colloidal or precipitated silicas, fumed metal oxides, e.g., silica or alumina, polymeric spheres, nanoparticles, e.g., ceria, and many others.

Slurries designed to remove insulating materials, for instance, often contain water, an abrasive and an alkali formulation for hydrolyzing the insulating material. Copper slurries on the other hand, can include water, an abrasive, an oxidizing agent and a complexing agent. Abrasive-free slurries also have been developed and are becoming increasingly available.

Upon contact with the slurry, dissolution of the filler increases the porosity at the working surface of the pad. The voids generated by filler particles that have dissolved in the slurry can have characteristics, e.g., pore size, pore distribution, pore forming speed, that are different from the voids introduced by gas frothing, resulting in a dual pore structure at the working surface of the pad.

Fillers that are soluble in the CMP slurry, can be provided in a particle size suitable for the application. To generate a dual porosity at the working surface, the particle size of the filler(s) preferably is different from the cell size introduced in the material by gas frothing. Multiple porosities can be imparted to the working surface by using filler(s) in two or more particle sizes that are different from the cell size formed throughout the material by frothing.

Fillers having a particle size that is the same or essentially the same as the pore size generated by frothing also can be employed.

In many cases, the filler has a particle size, e.g., an average particle size in the range of from about 1 μm to about 100 μm, preferably from about 5 μm to about 80 μm. In specific examples, the filler has an average particle size within the range of from about 20 μm to about 50 μm.

For aqueous CMP slurries, preferred fillers are water-soluble. Examples include fillers made of organic water-soluble materials, such as saccharides, polysaccharides, e.g., starch, dextrin and cyclodextrin, lactose, mannitol, etc., celluloses, e.g., hydroxypropyl cellulose, methyl cellulose, etc., proteins, polyvinyl alcohol, polyacrylic acid and salts thereof, polyethylene oxide, water-soluble photosensitive resins, sulfonated polyisoprene and sulfonated polyisoprene copolymers. Inorganic water-soluble fillers such as, for instance, potassium acetate, potassium nitrate, potassium carbonate, potassium hydrogencarbonate, potassium chloride, potassium bromide, potassium phosphate, magnesium nitrate and others also can be used.

In specific embodiments, the slurry-soluble filler does not dissolve in ingredients employed to form the microcellular material. In other specific embodiments, the filler affects chemical reactions, e.g., cross-linking, taking place during the preparation of the microcellular material. For instance, the filler can react with the pre-polymer, the curative or both during frothing and/or curing step(s).

A preferred filler is polyvinylpyrrolidone or PVP. PVP is a vinyl polymer that can be prepared by free radical polymerization of the monomer vinylpyrrolidone. Its chemical structure is represented by the formula:

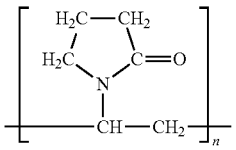

PVP is soluble in water and in solvents such as ethanol and others and is used in pharmaceutical, cosmetic and personal care formulations as well as in other applications.

Commercially, it is available in solution as well as in powder form. As known in the art, particle sizes of granular materials can be controlled, e.g., by sieving. Suitable average particle sizes are in the range of from about 1 μm to about 100 μm, preferably from about 5 μm to about 80 μm. In specific examples, the average PVP particle size is within the range of from about 20 μm to about 50 μm.

PVP can be obtained, for example, from BASF Corporation, Florham Park, N.J., under the designation of Luvitec® K-15, K-30, K-60 and K-90. These products have different viscosity grades and average molecular weights of about 10,000, 40,000, 60,000 and 360,000, respectively.

Filler amounts can be selected to produce a desired porosity at the interface of the microcellular material and the workpiece. While filler concentrations that are too low can result in insufficient porosity, concentrations that are too high can lead to aggregation and loss of pore uniformity. Based on the total weight of the pad, the slurry soluble filler can be present in an amount in the range of from about 0.2 to about 40 wt %, preferably from about 1 to about 20 wt %. In one preparative example, based on the total weight of prepolymer, surfactant, filler and curative, the filler is present in an amount within the range of from about 1 to about 20 wt %.

The filler can be combined with any of the ingredients and at any stage of forming the microcellular material. Preferably, at least a portion of the filler is combined with a froth produced, e.g., by gas frothing of the urethane prepolymer in the presence of a surfactant.

A particularly preferred system includes an aliphatic isocyanate polyether prepolymer; a polysiloxane-polyalkylene oxide surfactant; a filler soluble in a CMP slurry; a curative that includes an aromatic diamine; and, optionally, a triol.

The system used for forming the polymeric material optionally can include other ingredients, such as catalysts, additional fillers, processing aids, e.g., mold release agents, additives, colorants, dyes, antioxidants, stabilizers, lubricants and so forth.

Catalysts, for instance, are compounds that are added, typically in small amounts, to accelerate a chemical reaction without being consumed in the process. Suitable catalysts that can be used to produce polyurethane from prepolymers include amines and in particular tertiary amines, organic acids, organometallic compounds such as dibutyltin dilaurate (DBTDL), stannous octoate and others.

Additional fillers can be added to further affect polishing properties of a CMP pad, e.g., material removal rates, to promote porosity or for other reasons. Specific examples of suitable fillers include but are not limited to particulate materials, e.g., fibers, hollow polymeric microspheres, functional fillers, nanoparticles and so forth.

In another aspect, the invention relates to preparing a microcellular polyurethane material. In a preferred process, a urethane prepolymer is combined with a surfactant and frothed to produce a froth which will be cured in the presence of a curative. A filler that is soluble in a CMP slurry, e.g., PVP, is included. The slurry-soluble filler can be added at any stage of the preparation process.

In specific examples, the filler is added at the frothing stage, e.g., before, during and preferably after formation of the froth. Preferred froth-filler combinations and amounts produce uniform microcellular structure, with reduced cell of filler clustering. Froth-filler mixing can be conducted using paddles, stirrers, propellers, agitators, vortex mixers or other suitable mixing devices.

One or more optional ingredient(s) e.g., catalysts, fillers, processing aids, additives, dyes, antioxidants, stabilizers, lubricants and so forth can be added to or can be present in the prepolymer, curative or surfactant. One or more such ingredients also can be added during frothing or to the resulting foam.

Frothing can be conducted with nitrogen or another suitable gas, using equipment such as commercial casters with pressurized or non-pressurized tanks and distribution system or other mixing systems.

The structure imparted by frothing includes gas bubbles, also referred to herein as voids or pores, that are introduced into the material being frothed, and these can be characterized by a mean pore size, pore count and/or pore surface area percentage. Uniform bubbles are preferred as are microscopic mean pore sizes.

In many instances, typical frothing temperatures can be within the range of from about 50 to about 230° F., e.g., 130 to about 185° F.; frothing time can be within the range of from about 12 to about 240 minutes; gas, e.g., nitrogen, flow can be within the range of from about 1 to about 20 standard cubic feet per hour; mixing speed can be within the range of from about 500 to about 5000 rotations per minute (RPM).

The pot can be maintained at ambient conditions or under pressure, e.g., up to about 10 atmospheres.

The froth is cast and cured in the presence of the curative to produce the polyurethane material.

Casting can be conducted by pouring the foam into a mold, for instance a mold suitable for producing a desired CMP pad. Mold dimensions and shapes useful in manufacturing CMP pads are known in the art.

Curing or hardening the froth to produce a microcellular polyurethane material can be carried out in an oven, e.g., a box oven, convey oven or another suitable oven, at a suitable curing temperature and for a suitable period of time. Systems such as described above can be cured at a temperature in the range of from about 50 to about 250° F., e.g., 235° F., for a period of time of about 30 minutes. The curing process and its end point can be determined by evaluating the viscosity and hardness of the system.

Curing can be conducted in air or under special atmospheres, e.g., nitrogen, or another suitable gas or gas mixture.

After it is determined that curing is completed, for instance at the point when the system in the mold can no longer be poured, the hardened microcellular product is released from the mold and can be post-cured in an oven at a suitable temperature and for a suitable period of time. For instance the hardened product can be post-cured at a temperature within the range of from about 200 to about 250° F. e.g., 235° F. for several hours, e.g., 8-16.

Following post-curing, the microcellular product also can be conditioned at room temperature for a period of several hours to a day or longer.

In one example of the invention, gas, e.g., inert gas is used to form a froth containing gas, aliphatic isocyanate polyether prepolymer and polysiloxane-polyalkylene oxide surfactant. The froth is combined with the filler and the resulting composition is cured in the presence of the curative and optional triol.

The microcellular material described herein preferably has a Bashore rebound within the range of from about 25% to about 50%. In specific examples, the Bashore rebound of the microcellular material is less than 36%.

The material can have a density within the range of from about 0.6 to about 1.0 g/cm$^3$, preferably within the range of from about 0.80 to about 0.95.

In some embodiments, the hardness of the microcellular polymeric material is in the range of from about 30 to about 80 D.

Within the body of the material, the porous structure generated by frothing preferably has a cell size, also referred to as "pore" size, that is uniform throughout the material. The mean pore size of this first pore structure can be in the rage of from about 2 microns (μm) to about 200 μm. In some specific instances, the mean pore size is greater than about 30 microns (μm), for example within the range of from about 50 to about 100 μm and larger, e.g., up to about 120 μm and higher. Pore area % can range from about 5% to about 60%.

Upon contact with a CMP slurry, additional pore structure can be created at the working surface by dissolution of the slurry-soluble filler. The pore size of this secondary pore structure can be the same or different from the pore size of the first, i.e., frothing induced, pore structure.

In one example, the working surface has (a) cells of about 35 μm created through gas frothing; and (b) cells of about 10 μm formed by dissolving a slurry-soluble filler having a particle size of about 10 μm. Other dual or multiple porosities can be generated at the surface of the pad to meet requirements of specific polishing applications, removal rates and/or defect performance.

Without wishing to be held to a particular mechanism or interpretation, it is believed that frothing with a non-reactive gas, e.g., nitrogen or another inert gas, in the presence of surfactant affects pore distribution and size during foaming. During frothing, the surfactant appears to control pore size and distributions by controlling surface tension at the air/liquid interface. Fillers such as PVP may contribute to properties of the microcellular material, for example by participating in or affecting physical and chemical processes taking place during frothing and/or curing.

CMP pads manufactured using a system and method such as described above can be utilized with slurries designed for polishing copper as well as aluminum-based electronic components, in the planarization or polishing of semiconductors, optical, magnetic or other substrates. During polishing, the slurry-soluble filler dissolves in the slurry, generating voids at the working surface of the pad. Whereas the body of the pad includes pores introduced during frothing, the pad working surface has not only porosity generated by frothing but also porosity resulting from dissolution of the slurry-soluble filler. Controlling frothing conditions, choice of surfactant, filler particle size, filler concentration and/or other parameters can combine to design pads having desired rebound and pore structure.

Exemplification

General Prepolymer Casting Procedure 150-200 grams of each prepolymer were weighed into a pre-weighed pint tin can (~500 ml). The tin can was placed on a hot plate and the contents were heated to 70° C., as monitored by a thermometer, while stirring. The tin can was then placed in a vacuum chamber to remove any dissolved gases for about 3-5 minutes. The temperature of the prepolymer was measured again with the thermometer and was maintained at 60° C. If needed, the prepolymer was heated again on the hot plate. The actual weight of the prepolymer in the tin can was measured accurately on a scale by subtracting the weight of the tin can from the total weight.

Curative was poured into the can of prepolymer on the scale within 30 seconds and a timer was pressed immediately. Unless otherwise indicated, the curative was added at a level to give a combination of amine and hydroxyl groups at about 95% of the available isocyanate groups in the prepolymer on an equivalent basis.

After the desired amount of the curative had been added, the system was hand-mixed gently, using a spatula (1.5"×6") for about one minute, to minimize air bubble entrapping. The mixture was then poured into button or slab aluminum molds, pre-sprayed with mold release agent, and preheated to 235° F. in a box oven. Seven (7) buttons having a diameter 1" and a height of 0.5" were prepared. Elastomeric sheets prepared were about 1/16" or 1/4 inch thick.

Curing was conducted in a box oven at 235° F. The pot life of the mixture was monitored until the mixture in the tin could not be poured. After 10 minutes, the button mold was taken out from the oven and the top portions of the button samples were cut with a utility knife to test the easiness of the cutting and the brittleness or strength of the material at this green curing stage. Both button and slab molds were de-molded at about 20-30 minutes to check the de-moldability.

The buttons and sheets were then post-cured for about 16 hours at 235° F. They were conditioned at room temperature for at least 1 day before hardness and rebound tests and for at least 7 days before any other physical testing.

Prepolymer Frothing with Surfactant Choice 500 g of the chosen prepolymer (melted overnight, if needed, in an oven at 150° F.) was poured into a dry quart-sized tin can (de-rimmed). A surfactant was selected and 7.5 g of a chosen surfactant was added into the can. The can was placed on a hot plate for heating and then equipped with a holding chain attached to a stable stand, with a copper tubing inserted into the bottom of the can for nitrogen bubbling and with a mechanical mixer with a 3" propeller. The copper tubing was connected to a polyethylene (PE) tubing from a dry nitrogen tank via a gas flow meter. The mixer was set to about 800 rotations per minute (rpm) for uniform mixing while heating the tin can on the hot plate.

When the temperature in the can reached 140° F. to 150° F. (measured by a IR temperature gun), the mixing speed was increased to 1500 rpm (measured by a tachometer) and nitrogen bubbling was turned on at 5 standard cubic feet per hour (SCFH). Timing the nitrogen frothing was started and the liquid level in the can was immediately measured from the top rim by a ruler for frothing volume monitoring. After 45-120 minutes of frothing, the liquid level was measured again for the frothing volume calculation using the known can diameter (typical 30% increase). The frothed prepolymer was manually cast with the chosen curative within 30 minutes and kept in an oven at a temperature of 150° F.

Frothed Prepolymer Cast with Curative Choice

About 150 g of the frothed prepolymer at 150° F. was poured into a dry pint tin can (de-rimmed). Stopwatch timing was started and the calculated amount of the curative choice, e.g. ET5 (95% E300+5% TMP), in a 500 ml brown glass bottle kept in 150° F. oven for use was added into the pint can with a disposable plastic pipette in about 40 seconds.

Mixing the mixture in the can with a 1.5 inch-wide metal spatula was immediately started and was continued for one minute, avoiding any air bubble entrapment. The reaction mixture was poured into two molds: 1 inch button mold and 1/16 inch slab mold, both pre-wiped with Stoner M800 mold release agent and pre-heated at 235° F. in an oven before casting.

Both filled molds were placed in a box oven at 235° F. The timing was closely monitored and the mixture viscosity in the can was frequently checked with the spatula until it was no longer possible to pour the mixture for the pot life measurement which was typically 6-7 minutes. After 10 minutes, the flat portions of the button samples were cut off with a utility knife to check cutting processability. Both button and slab samples were demolded in about 30 minutes from the mixing point. The demolded samples were placed in 235° F. oven for a 16 hour post curing period. The button samples were used to measure hardness (Shore D), rebound (Bashore), density and porosity. For hardness and rebound measurements, the button samples were conditioned at ambient temperature for 1+ day.

Materials

The urethane prepolymers employed in the experiments described below were obtained commercially and included: Adiprene®) LF 750 D (a TDI-PTMEG prepolymer, LF, having a NCO of 8.79 wt %); Airthane® PHP-80D (TDI-PTMEG prepolymer, LF, having a NCO of 11.1 wt %); L 325 (TDI/H12MDI-PTMEG prepolymer, having a NCO of 9.11 wt %); LFG 740D (TDI-PPG prepolymer, LF, having a NCO of 8.75 wt %); LW 570 (H12MDI-polyether prepolymer, having a NCO of 7.74 wt %); and LFH 120 (HDI-polyether prepolymer, LF, having a NCO of 12.11 wt %). The prepolymers are listed in Table A and are identified by their commercial name, chemical composition, supplier, and % NCO.

TABLE A

| Prepolymer ID | Commercial Name | Isocyanate | Polyol Backbone | Supplier | % NCO |
|---|---|---|---|---|---|
| A | LF750D | TDI, LF | polyether | Chemtura | 8.79 |
| B | PHP-80D | TDI, LF | polyether | Air Products | 11.1 |
| C | L325 | TDI/H12MDI | polyether | Chemtura | 9.11 |
| D | LFG740D | TDI, LF | PPG | Chemtura | 8.75 |
| E | LW570 | H12MDI | polyether | Chemtura | 7.74 |
| F | LFH120 | HDI, LF | polyether | Chemtura | 12.11 |
| G | 8570 | TDI | polyester | Chemtura | 6.97 |

Example 1

Several curatives were evaluated for each of the polyurethane prepolymers identified as A through G in Table A. The curative tested included a commercially aromatic diamine identified herein as MOCA; Ethacure® 300 (from Albermarle Corporation) identified herein as E300, Ethacure® 100 (from Albermarle Corporation), identified herein as E100; butanediol, abbreviated herein as BDO; and several mixtures of aromatic diamines and triols, abbreviated as EP10, EA10, ET5, ET10, E1T5 and E1T10, and defined as follows:

$$EP10=E300+10\%TP30$$

$$EA10=E300+10\%A931$$

$$ET5=E300+5\%TMP$$

$$ET10=E300+10\%TMP$$

$$E1T5=E100+5\%TMP$$

$$E1T10=E100+10\%TMP$$

where TMP is trimethanolpropane, TP30 is modified TMP and A931 is an aliphatic amino triol. Percentages are weight percentages.

Table 1 lists systems that were studied, each system corresponding to a combination of a specific urethane prepolymer and a specific curative. Table 1 identifies each system by the letter corresponding to the urethane prepolymer (from Table A), followed by a numeral related to the specific curative employed. For instance, system E5 included the aliphatic isocyanate polyether prepolymer LW570 and the curative ET5; system F3 included the aliphatic isocyanate polyether prepolymer LFH120 and the curative ET5; and G2 included the aromatic isocyanate polyester prepolymer 8570 and the curative E300.

The solid product obtained by combining, under polymerization conditions, the specific prepolymer with the specific curative in each system was evaluated with respect to hardness and Bashore rebound. In some cases, other parameters such as processability and CMP slurry immersion also were studied.

The solid product obtained using system C1, where the prepolymer was L325 and the curative was MOCA is a comparative material formed using L325-MOCA. Microsphere fillers are added when the material is fabricated into a polishing pad.

Sample A2 (LF750D and MOCA) had a Bashore rebound of 42% and was used as a benchmark.

TABLE 1

| System ID | Prepolymer | Curative | % Theory (%) | Hardness | Bashore Rebound (%) |
|---|---|---|---|---|---|
| A1 | LF750D | MOCA | 95 | 74 | 55 |
| A2 | | E300 | 95 | 74 | 42 |
| A3 | | ET5 | 95 | 73 | 37 |
| A4 | | ET10 | 96 | 74 | 41 |
| A5 | | EP10 | 97 | 73 | 42 |
| B1 | PHP-80D | MOCA | 95 | 80 | 66 |
| B2 | | E300 | 99.6 | 81 | 45 |
| B3 | | ET5 | 95 | 81 | 39 |
| B4 | | ET10 | 95 | 80 | 37 |
| B5 | | EA10 | 96 | 80 | 37 |
| C1 | L325 | MOCA | 90 | 72 | 58 |
| C2 | | E300 | 96 | 73 | 39 |
| C3 | | ET5 | 100 | 73 | 44 |
| C4 | | ET10 | 95 | 72 | 39 |
| D1 | LFG740D | MOCA | | 75 | 43 |
| D2 | | E300 | 95 | 73 | 38 |
| D3 | | ET5 | 95 | 75 | 38 |
| D4 | | EP10 | 95 | 73 | 41 |
| E1 | LW570 | MOCA | 95 | 73 | 40 |
| E2 | | E300 | 95 | 70 | 40 |
| E3 | | E300 | 95 | 70 | 38 |

TABLE 1-continued

| System ID | Prepolymer | Curative | % Theory (%) | Hardness | Bashore Rebound (%) |
|---|---|---|---|---|---|
| E4 | | E100 | 95 | 70 | 41 |
| E5 | | ET5 | 95 | 68 | 32 |
| E6 | | ET10 | 95 | 69 | 38 |
| F1 | LFH120 | BDO | 98 | 65 | 47 |
| F2 | | E300 | 95 | 70 | 42 |
| F3 | | ET5 | 99 | 67 | 34 |
| F4 | | ET10 | 95 | 64 | 37 |
| G1 | 8570 | MOCA | 95 | 73 | 30 |
| G2 | | E300 | 100 | 70 | 29 |
| G3 | | E300 | 95 | 70 | 33 |
| G4 | | ET5 | 95 | 72 | 31 |
| G5 | | EA10 | 95 | 70 | 31 |

Samples B2, B3 and B4 were found to be brittle at 10 minutes at room temperature. Sample E2 had high viscosity and sample E3 had a longer than usual pot life. Except for sample E6, the remaining samples presented in Table 2 exhibited adequate processability.

Several samples were tested for chemical resistance or stability under CMP slurry, such as acid slurry SS12 from Cabot Microelectronics and Base Slurry Cu C2-039 from Praxair Surface Technology.

Among them, samples A2, A3, B5, C2, E5, G2 and G3 were found to be stable.

System B1 had high hardness. System E1 had high viscosity and resulted in a damping sample. High viscosity also was present in samples E5 and G4. Samples E3 and G3 were damping. Systems characterized by very low viscosity included F2 and F3.

The data indicated that aliphatic isocyanate polyether prepolymers tended to produce a solid material having a Bashore rebound lower than that of solid materials obtained using aromatic isocyanate polyether prepolymers. Adding triol, in particular at optimal levels, to the aromatic diamine tended to reduce the Bashore rebound when compared to neat aromatic diamine.

A preferred system was the very low viscosity system F3 which resulted in a material having a Bashore rebound of 34%. Also preferred were systems E5 and G2.

Example 2

Surfactant screening was performed using systems E5, F3 and G2. The surfactants screened were (Niax®) L-7500, L-5614, L-1580 obtained from GE Silicones; DC-193, DC-5604 and DC-5164 from Air Products and Chemicals; and DC-309, 5098EU and Q2-5211 from Dow Corning Corporation.

Results regarding foaming properties are shown in Table 2.

TABLE 2

| Surfactant | E5 (LW570 + ET5) | F3 (LFH120 + ET5) | G2 (8570 + E300) |
|---|---|---|---|
| L-7500 | F | | 0 |
| L-5614 | FF | | F |
| L-1580 | F | | FF |
| DC-193 | FFF | FFF | FFF |
| DC-5604 | FF | | FF |
| DC-5164 | FFF | | F |
| DC-309 | FFF | FF | |
| 5098EU | FF | | |
| Q2-5211 | FFFF | FFF | |

where 0 indicates no foaming, F indicates some foaming and FF indicates partial foaming. FFF and FFFF indicate, respectively, strong foaming and very strong foaming.

As seen in Table 2, in the case of aliphatic isocyanate polyether prepolymers, DC-193 (D) and Q2-5211 (Q) produced strong or very strong foaming.

Example 3

Systems identified in Table 1 as A2, A3, B5, C2, C4, D2, D3, E5, E4, F2, F3, G2 and G4 were used for further frothing and curing testing.

First, prepolymers in each of the A2, A3, B5, C2, C4, D2, D3, E5, E4, F2, F3, G2 and G4 systems were frothed with nitrogen using the surfactants, surfactant levels and conditions shown in Table 3A. Generally nitrogen flow was at 5 standard cubic feet per hour (SCFH). In Table 3A, L stands for Niax® surfactant L-1800; D for DC-193 and Q for Q2-5211 and the right hand column lists the approximate volume % increase that was observed in each case.

In one illustrative example, 500 g of Adiprene® LFH120 prepolymer (melted overnight in 150° F. oven) from Chemtura was poured into a dry quart-sized tin can (de-rimmed). Then 7.5 g of DC-193 surfactant from Air Products was added into the can. The can was placed onto a hot plate for heating and then equipped with a holding chain attached to a stable stand, with a copper tubing inserted into the bottom of the can for nitrogen bubbling and with a mechanical mixer with a 3" propeller (see Fig. 1). The copper tubing was connected to a PE tubing from a dry nitrogen tank via a gas flow meter. The mixer was set to about 800 rpm for uniform mixing when the hot plate was on for heating the can. When the temperature in the can reached 140° F. (measured by a IR temperature gun), the mixing speed was increased to the highest setting (1500 rpm, measured by a tachometer) and nitrogen bubbling was turned on at 5 SCFH. The nitrogen frothing started timing and liquid level in the can was immediately measured from the top rim by a rule for frothing volume monitoring. After 45' frothing, the liquid level was measured again for the frothing volume calculation (typical 30% increase). The frothed LFH120 was manually cast with different filler addition and curative within 30', kept temperature at 140° F. in an oven.

The froths were then cast and cured in the presence of the curative to produce microcellular polyurethane samples.

In one example, 130.8 g of the frothed LFH120 at 140° F. was poured into a dry pint tin can (de-rimmed). Started stopwatch timing and then added 35.4 g of ET5 (95% E300+5% TMP in a 500 ml brown glass bottle kept in 150° F. oven for use) into the pint can with a disposable plastic pipette in about 40". Immediately started to mix the mixture in the can with a 1.5" wide metal spatula for one minute, avoiding any air bubble entrapment. Poured the reaction mixture into two molds: 1" button mold and 1/16" slab mold, both pre-wiped with Stoner M800 mold release agent and pre-heated in 235° F. oven before casting. Both filled molds were placed in a box oven at 235° F. The timing was closely monitored and the mixture viscosity in the can was frequently checked with the spatula until the mixture was unable to be poured for the pot life measurement (typical 6-7'). After 10', the flat portions of the button samples were cut off with a utility knife to check die-cutting processability. Both button and slab samples were demolded in about 30 minutes from the mixing point. The demolded samples were placed in 235° F. oven for 16 hour postcuring. The button samples were used to measure hardness (Shore D), rebound (Bashore), density and porosity. For hardness and rebound measurements, the button samples were conditioned at ambient temperature for 1+ day.

Properties of the microcellular polyurethane materials are presented in Table 3B.

As seen in the left hand column of Tables 3A and 3B, many of the combinations of prepolymer and curative identified in Table 2 are further described by surfactant type, level and/or frothing conditions. For instance the sample identified as F3-b was formed by frothing the prepolymer LFH120 with nitrogen, in the presence of DC-193 surfactant, at surfactant level of 1.5 PHR, using 1500 RPM mixing for 120 minutes; and curing the resulting froth in the presence of the curative ET5.

TABLE 3A

| Sample ID | Surfactant Level (PHR) and Surfactant Type | Temp (° F.) | Mixing (RPM) | Frothing Time (Min) | Approximate Volume Increase (%) |
|---|---|---|---|---|---|
| A2-a | 0.5 L | 150 | 1300 | 90-180 | |
| A2-b | 0.5 L | 150 | 750-1500 | 60 | 25 |
| A2-c | 0.5 L | 150 | 1500 | 90 | 25 |
| A2-d | 1.5 L | 150 | 1500 | 60 | 30 |
| A3-a | 0.5 L | 150 | 750-1500 | 60 | 25 |
| A3-b | 0.5 L | 150 | 1500 | 90 | 25 |
| A3-c | 1.5 L | 150 | 1500 | 60 | 30 |
| B5 | 1.5 L | 150 | 1500 | 60 | 30 |
| C2 | 1.5 L | 150 | 1500 | 60 | 30 |
| C4 | 1.5 L | 150 | 1500 | 60 | 30 |
| D2 | 1.5 L | 150 | 1500 | 60 | 30 |
| D3 | 1.5 L | 150 | 1500 | 60 | 30 |
| E5 | 1.5 L | 190-210 | 1500 | 90 | 5 |
| E4-a | 1.5 L | 190-210 | 1500 | 90 | 5 |
| E4-b | 1.5 Q | 185 | 1500 | 50 | 35 |
| E4-c | 1.5 D | 185 | 1500 | 16 | 50 |
| F2 | 1.5 L | 130->100 | 1500 | 120 | 30 |
| F3-a | 1.5 L | 130->100 | 1500 | 120 | 30 |
| F3-b | 1.5 D | 140 | 1500 | 45 | 30 |
| G2 | 1.5 D | 185 | 1500 | 60 | 34 |
| G4 | 1.5 L | 180 | 1500 | 60 | <5 |

TABLE 3B

| Froth ID | Hardness Shore D | Density (g/cm$^3$) | Mean Pore Size (μm) | Pore Area % |
|---|---|---|---|---|
| A2-a | 65 | 0.90 | 30-40 | 15-20 |
| A2-b | 67 | 099 | 62 | 15.2 |
| A2-c | 67 | 0.98 | 66 | 14.2 |
| A2-d | 66 | 0.90 | 71 | 20.3 |
| A3-a | 67 | 0.99 | 67 | 15.5 |
| A3-b | 67 | 0.98 | | |
| A3-c | 65 | 0.89 | 66 | 20.8 |
| B5 | 65 | 0.79 | 59 | 27.3 |
| C2 | 57 | 0.77 | 63 | 27.7 |
| C4 | 56 | 0.75 | | |
| D2 | 56 | 0.80 | 57 | 28.8 |
| D3 | 56 | 0.80 | | |
| E4-a | 67 | 1.01 | | |
| E4-b | 57 | 0.74 | | |
| E4-c | 54 | 0.66 | 106.2 | 31.2 |
| F2 | 57 | 0.85 | >100 | |
| F3-a | 56 | 0.86 | | |
| F3-b | 61 | 0.96 | 87.2 | 18.4 |
| G2 | 53 | 0.76 | 74.7 | 34.6 |
| G4 | 72 | 1.21 | | |

Example 4

Frothing conditions for preparing froth compositions based on prepolymer-curative systems A2 (LF750D+E300); A3 (LF750D+ET5); F2 (LFH120+E300); and F3 (LFH120+ET5) are shown in Table 4A below. As seen in Table 4A, Samples III, V, VI and VII were not frothed.

TABLE 4A

| Sample # | System ID | Surfactant Level (PHR) and Type | Temp (° F.) | Mixing (RPM) | Frothing Time (Min) | Volume Increase (%) |
|---|---|---|---|---|---|---|
| I | A2 | 0.5 L | 150 | 1300 | 120 | — |
| II | A2 | 1.5 L | 150 | 1500 | 60 | ~30 |
| III | A2 | 0 | — | — | — | — |
| IV | A3 | 1.5 L | 150 | 1500 | 60 | ~30 |
| V | A3 | 0 | — | — | — | — |
| VI | F2 | 0 | — | — | — | — |
| VII | F3 | 0 | — | — | — | — |
| VIII | F3 | 1.5 D | 140 | 1500 | 45 | ~30 |

PVP filler was incorporated into the material as follows. 100.0 g of the frothed LFH120 at 140° F. was poured into a dry pint tin can (de-rimmed) and 15.0 g of K30 PVP powder, obtained from BASF Corp., Florham Park, N.J., was added and mixed well with a 1.5" wide metal spatula for 2 minutes until uniform.

Stopwatch timing was begun and 26.9 g of ET5 (95% E300+5% TMP in a 500 ml brown glass bottle kept in 150° F. oven for use) was added into the pint can with a disposable plastic pipette in about 40". Mixing the mixture in the can with the 1.5" wide metal spatula for one minute, avoiding any air bubble entrapment, was immediately started. The reaction mixture was poured into two molds: 1" button mold and 1/16" slab mold, both pre-wiped with Stoner M800 mold release agent and pre-heated in 235° F. oven before casting.

Both filled molds were placed in a box oven at 235° F. The timing was closely monitored and the mixture viscosity in the can was frequently checked with the spatula until the mixture could not be poured for the pot life measurement (typical 6-7 minutes). After about 10 minutes, the flat portions of the button samples were cut off with a utility knife to check die-cutting processability. Both button and slab samples were de-molded in about 30 minutes from the mixing point. The de-molded samples were placed in 235° F. oven for 16 hour postcuring period.

In addition to PVP (abbreviated as K30), the following fillers also were evaluated: fine corn starch; methyl cellulose powder, abbreviated as A15C, obtained from Dow Chemical Company; super absorbent polymer, abbreviated as SAP and obtained under the designation of Luquasorb® from BASF Chemical Company; and hollow elastic polymeric microspheres, abbreviated as d42, obtained from Akzo Nobel under the designation of Expancel®.

The following procedure was employed, for instance, to obtain a microcellular material that includes Expancel® particles.

82.0 g of the frothed LFH120 at 140 F was poured into a dry pint tin can (de-rimmed) and 1.0 g of Expancel® 551DE40d42 powder, obtained from Akzo Nobel was added and mixed well with a 1.5" wide metal spatula for 3 minutes, until uniform. Stopwatch timing was started right before adding 22.3 g of ET5 (95% E300+5% TMP in a 500 ml brown glass bottle kept in 150° F. oven for use) into the pint can with a disposable plastic pipette in about 40 seconds. Mixing the composition in the can was started immediately using a 1.5" wide metal spatula for one minute, avoiding any air bubble entrapment. The reaction mixture was poured into two molds: 1" button mold and 1/16" slab mold, both pre-wiped with Stoner M800 mold release agent and pre-heated in 235° F. oven before casting. Both filled molds were placed in a box oven at 235° F. The timing was closely monitored and the mixture viscosity in the can was frequently checked with the spatula until the mixture could no longer be poured for the pot life measurement (typical 6-7 minutes). After about 10 minutes, the flat portions of the button samples were cut off with a utility knife to check die-cutting processability. Both button and slab samples were de-molded in about 30 minutes from the mixing point. The de-molded samples were placed in 235° F. oven for a 16 hour postcuring step. The button samples were used to measure hardness (Shore D), rebound (Bashore), density and porosity. For hardness and rebound measurements, the button samples were conditioned at ambient temperature for 1+ day.

The button samples were used to measure hardness (Shore D), rebound (Bashore), density and porosity. For hardness and rebound measurements, the button samples were conditioned at ambient temperature for 1+ day.

Generally, Bashore rebound was measured on the solid product formed by curing the urethane prepolymer in the presence of the curative.

In some instances, Bashore rebound also could be measured reproducibly on the microcellular materials. Repeated strokes of a microcellular material that utilized LFH120 and PVP filler, for instance, gave a Bashore rebound less than 38.

Samples were combined with various fillers and filler amounts as shown in Table 4B below. Where appropriate, froth-filler mixing conditions (RPM, time in minutes and temperature in ° C.) are provided. In other cases the filler was omitted, while Samples III, V, VI and VII) were combined with filler in the absence of frothing.

TABLE 4B

| Sample ID | Filler Type | Filler Level (wt %) | Froth-Filler Mixing (RPM; min;) | Mixing Temperature (° C.) |
|---|---|---|---|---|
| I | — | — | — | — |
| II | — | — | — | — |
| III + K30 | K30 | 4.8% | 1100; 10 | 90 |
| IV | — | — | — | — |
| V + K30 | K30 | 15.6 | 1400; 15 | 65 |
| V + starch | Starch | 15.5 | 1500; 10 | 60 |
| V + SAP | SAP | 15.3 | 1500; 10 | 85 |
| VI | — | — | — | — |
| VII | — | — | — | — |
| VII + SAP | SAP | 26.6 | 800; 10 | 60 |
| VII + A15C | A15C | 19.3 | Spatula; 2 | 70 |
| VII + starch | Starch | 23.8 | 800; 10 | 75 |
| VII + K30 | K30 | 20.8 | Spatula; 3 | 50 |
| VII + K30 | K30 | 14.9 | 500; 5 | 45 |
| VIII + K30 | K30 | 10.6 | Spatula; 2 | 60 |
| VIII + d42 | D42 | 0.90 | Spatula; 3 | 50 |
| VIII | — | — | — | — |

Samples listed in Table 4B were evaluated for hardness (Shore D) and Bashore rebound. These and other properties are shown in Table 4C:

TABLE 4C

| Sample ID | Hardness (Shore D) | Bashore Rebound (%) | Density (g/cm$^3$) | Mean Pore size (μm) | Pore Area % |
|---|---|---|---|---|---|
| I | 65 | — | 0.90 | 30-40 | 15-20 |
| II | 66 | — | 0.90 | 71 | 20.3 |
| III + K30 | 74 | 40 | 1.15 | | |
| IV | 65 | — | 0.89 | | |
| V + K30 | 67 | 36 | 0.93 | | |
| V + starch | 70 | 33 | 0.86 | | |
| V + SAP | 64 | 40 | 1.05 | | |
| VI | 70 | 42 | | | |
| VII | 67 | 34 | | | |
| VII + SAP | 70 | 27 | 1.17 | | |
| VII + A15C | 60 | 44 | | | |

TABLE 4C-continued

| Sample ID | Hardness (Shore D) | Bashore Rebound (%) | Density (g/cm$^3$) | Mean Pore size (μm) | Pore Area % |
|---|---|---|---|---|---|
| VII + starch | 72 | 30 | 1.20 | | |
| VII + K30 | 66 | 43 | | 45.6 | 30.2 |
| VII + K30 | 70 | 28 | 1.05 | 48.7 | 23.3 |
| VIII + K30 | 61 | 35 | 0.89 | 65.2 | 39.1 |
| VIII + d42 | 50 | 30 | 0.73 | 39.6 | 33.9 |
| VIII | 61 | 37 | 0.96 | 87.2 | 18.4 |

Sample III+K30 did not appear to have enough filler. Small uniform fillers but believed not to be dense enough were seen in sample V+starch, while sample V+SAP showed a broad filler distribution not dense enough. Uniform solids with not enough filler were observed in the case of samples VII+SAP and VII+starch. Both starch and SAP appeared to dissolve in the case of sample V and sample VII. Sample VII+A15C showed big cavities. As seen in the case of Sample VIII, PVP produced a microcellular material with a desired hardness and Bashore rebound.

While this invention has been particularly shown and described with references to preferred embodiments thereof, it will be understood by those skilled in the art that various changes in form and details may be made therein without departing from the scope of the invention encompassed by the appended claims.

What is claimed is:

1. A method for producing a CMP pad, the method comprising:

a) frothing an aliphatic isocyanate polyether prepolymer with an inert gas, in the presence of a polysiloxane-polyalkyleneoxide surfactant, to form a froth;

b) combining the froth with a filler soluble in a CMP slurry to form a mixture;

c) forming a primary pore size distributed within the pad body;

d) forming a secondary pore size distributed along a working surface of the pad, wherein the secondary pore size is different from the primary pore size; and e) polymerizing the mixture in the presence of an aromatic diamine and, optionally, a triol, thereby producing the CMP pad.

2. The method of claim 1, wherein the filler is polyvinylpyrrolidone.

3. The method of claim 1, wherein the filler has a particle size that is different from a mean cell size produced by frothing.

4. The method of claim 1, wherein:

i) with respect to a theoretical amount, a curative that includes the aromatic diamine and the triol is in the range of from 90 to 105%;

ii) based on the total weight of a curative including the aromatic diamine and the triol, the triol is present in the curative in an amount within the range of from 0.2 to 15 weight %;

iii) the surfactant is present in an amount within the range of from 0.3 to 5 wt % based on the total weight of prepolymer and surfactant; or iv) based on the total weight of prepolymer, surfactant, filler and curative, the filler is present in an amount within the range of from about 1 to about 20 wt %.

5. The method of claim 1, wherein the aliphatic isocyanate is selected from the group consisting of hydrogenated methylene diphenyl diisocyanate, hexamethylene diisocyanate, isophorone diisocyanate and any combination thereof.

6. The method of claim 1, wherein, a solid product formed by curing the aliphatic isocyanate polyether prepolymer in the presence of a curative that includes the aromatic diamine and the triol has a Bashore rebound that is less than 38%.

7. The method of claim 1, wherein the froth is cured at a temperature within the range of from about 50 to about 250° F.

8. A method for producing a microcellular polyurethane pad, the method comprising:

a) frothing a urethane prepolymer to form a froth;

b) combining the froth with a filler that is soluble in a CMP slurry to form a mixture; and c) forming a primary pore size distributed within the pad body;

d) forming a secondary pore size distributed along a working surface of the pad, wherein the secondary pore size is different from the primary pore size; and e) curing the mixture in the presence of a curative, thereby producing the microcellular polyurethane pad, wherein, a solid product formed by polymerizing the urethane prepolymer in the presence of the curative has a Bashore rebound less than 38%.

9. The method of claim 8, wherein the curative includes an aromatic diamine and a triol.

10. The method of claim 8, wherein the urethane prepolymer is an aliphatic isocyanate polyether prepolymer or a polyester urethane prepolymer.

11. The method of claim 8, wherein the urethane prepolymer is frothed with dry air or with an inert gas selected from the group consisting of nitrogen, helium, argon, and any combination thereof in the presence of a surfactant.

12. The method of claim 8, wherein the froth is cured at a temperature within the range of from about 50 to about 250° F.

13. The method of claim 8, wherein the filler is PVP having a mean particle size that is different from a mean cell size produced by frothing.

14. The method of claim 8, wherein the microcellular polyurethane material has a Shore hardness in the range of from about 30 D to about 80 D.

15. The method of claim 8, wherein the microcellular polyurethane material has a density in the range of from about 0.5 to about 1.2 g/cm$^3$.

16. A method for producing a CMP pad, the method comprising:

a) frothing an aliphatic isocyanate polyether prepolymer with an inert gas, in the presence of a polysiloxane-polyalkyleneoxide surfactant, to form a froth;

b) combining the froth with a filler soluble in a CMP slurry to form a mixture; and c) polymerizing the mixture in the presence of an aromatic diamine and a triol, thereby producing the CMP pad;

d) forming a primary pore size distributed within the pad body;

e) forming a secondary pore size distributed at a working surface of the pad, wherein the secondary pore size is different from the primary pore size;

wherein, a solid product formed by curing the aliphatic isocyanate polyether prepolymer in the presence of a curative that includes the aromatic diamine and the triol has a Bashore rebound that is less than 38%.

17. The method of claim 16, wherein the filler is polyvinylpyrrolidone.

18. The method of claim 16, wherein the filler has a particle size that is different from a mean cell size produced by frothing.

* * * * *